US005899676A

United States Patent [19]

Iizuka

[11] Patent Number: 5,899,676

[45] Date of Patent: May 4, 1999

[54] OLDHAM COUPLING MECHANISM FOR A SCROLL TYPE FLUID DISPLACEMENT APPARATUS

[75] Inventor: Jiro Iizuka, Takasaki, Japan

[73] Assignee: Sanden Corporation, Gunma, Japan

[21] Appl. No.: 08/819,334

[22] Filed: Mar. 18, 1997

[30] Foreign Application Priority Data

Mar. 18, 1996 [JP] Japan ..... 8-61191

[51] Int. Cl.[6] ..... F01C 1/04

[52] U.S. Cl. ..... 418/55.3; 464/102

[58] Field of Search ..... 418/55.3; 464/102

[56] References Cited

U.S. PATENT DOCUMENTS

| | | | |
|---|---|---|---|
| 801,182 | 10/1905 | Creux | 418/55.3 |
| 3,994,633 | 11/1976 | Shaffer | 418/5 |
| 4,325,683 | 4/1982 | Miyazawa | 418/55.3 |
| 4,406,600 | 9/1983 | Terauchi et al. | 418/55.3 |
| 4,626,179 | 12/1986 | Terauchi | 418/55.2 |
| 4,645,435 | 2/1987 | Sugimoto | 418/55.3 |
| 4,655,696 | 4/1987 | Utter | 418/55.3 |
| 4,992,033 | 2/1991 | Caillat et al. | 418/55.3 |
| 5,211,550 | 5/1993 | Kawabe | 418/55.3 |
| 5,275,543 | 1/1994 | Tanaka et al. | 418/55.3 |

FOREIGN PATENT DOCUMENTS

| | | | |
|---|---|---|---|
| 0049881 | 4/1982 | European Pat. Off. . | |
| 58-160578 | 9/1983 | Japan | 418/55.3 |
| 63-138183 | 6/1988 | Japan | 418/55.3 |
| 63-170578 | 7/1988 | Japan | 418/55.3 |
| 04036084 | 2/1992 | Japan . | |

*Primary Examiner*—John J. Vrablik
*Attorney, Agent, or Firm*—Baker & Botts, L.L.P.

[57] ABSTRACT

A scroll type fluid displacement apparatus comprises a housing having an inlet port and an outlet port. An orbiting scroll has a circular end plate from which a spiral element extends and a pair of parallel grooves formed on the circular end plate. An Oldham coupling mechanism is disposed between the fixed scroll and the housing and includes a ring and a supporting member fixedly secured to the housing. The supporting member has a pair of parallel grooves formed on one end surface thereof. The ring has a pair of first parallel key portions and a pair of second parallel key potions. The second key portions are axially offset from the first key portions. The first key portions engage the grooves of the circular end plate of the orbiting scroll while the second key portions engage the grooves of the supporting means.

6 Claims, 8 Drawing Sheets

OLDHAM COUPLING MECHANISM FOR A SCROLL TYPE FLUID DISPLACEMENT APPARATUS

BACKGROUND OF THE INVENTION

1. Field Of The Invention

The present invention relates to a scroll type fluid displacement apparatus, and more particularly, to an Oldham coupling mechanism for a scroll type refrigerant compressor used in an automotive air conditioning system.

2. Description Of The Prior Art

Oldham coupling mechanisms of scroll type fluid displacement apparatuses are well known in the art. For example, U.S. Pat. No. 4,655,696 issued to Utter discloses a basic construction of an Oldham coupling of scroll type fluid displacement apparatus. A scroll type fluid displacement apparatus generally comprises two scroll members each having a spiral element. The scroll members are maintained angularly and radially offset so that the spiral elements interfit to form a plurality of line contacts between the spiral curved surfaces and thereby seal off and define at least one pair of fluid pockets. In operation, the relative orbital motion of the two scroll members shifts the line contact along the spiral curved surfaces and, therefore, the volume of the fluid pockets changes. Because the volume of the fluid pockets increases or decreases dependent on the direction of the orbital motion, the scroll type fluid displacement apparatus compresses, expands or pumps fluid. Oldham couplings are but one approach for preventing relative angular movement between the orbiting scroll and a fixed portion of the apparatus.

One such Oldham coupling mechanism is disclosed in Japan Utility Publication No. S62-66284. Referring to FIGS. 1 and 2, Oldham coupling mechanism comprises Oldham ring 59 having an opening 59*a* formed at the center thereof, and a fixed ring 58 fixed to the compressor housing. First end 59*b* of ring 59 slidably engages end surface 57*c* of orbiting scroll 57 and second end 59*c* of ring 59 slidably engages end surface 58*b* of fixed ring 58. First end 59*b* of ring 59 is subjected to the compression reaction forces generated during operation of the compressor. The compression reaction forces are transmitted through end 59*c* of ring 59 to fixed ring 58.

Boss 57*a* of orbiting scroll 57 is placed in opening 59*a* of Oldham ring 59. The outer diameter of boss 57*a* substantially corresponds to the width of opening 59*a*. Accordingly, boss 57*a* may move vertically, but not horizontally, relative to Oldham ring 59. Opening 59*a* is elliptical in shape. Boss 57*a* moves along the ellipse as shown in FIG. 2. Oldham ring 59, along with boss 57*a* positioned in opening 59*a*, slide horizontally within end surface 58*c* of fixed ring. The combined vertical movement of boss 57*a* in opening 59*a* along with horizontal movement along end surface 58*c* describes orbital movement of the orbiting scroll.

In this arrangement, first and second ends 59*b* and 59*c* of Oldham ring 59 support rust loads caused by the compression reaction forces of orbiting scroll 57, since the thickness of Oldham ring 59 is greater than the combined depth of wall 57*b* of orbiting scroll 57 and wall 58*b* of fixed ring 58. Accordingly, the first and second ends 59*b*, 59*c* must be designed with sufficient surface area to sustain the thrust loads without seizure. Such design criteria, however, inevitably increase the size and weight of the Oldham coupling. Furthermore, the movement of the orbiting scroll imparts an inertia force on the Oldham ring 59, resulting in vibration of Oldham ring 59. The magnitude of vibration increases in proportion to the weight of the Oldham ring 59. Consequently, competing design criteria, i.e., size of Oldham ring to sustain thrust load vs. increased vibration, often dictate a less than desirable compromise.

On the other hand, if the thickness of Oldham ring 59 is Less than the combined depth of wall 57*b* of orbiting scroll 57 and wall 58*b* of fixed ring 58, fixed ring 58 ends up supporting the thrust load as surface 58*a* of fixed ring 58 slidably contacts axial end surface 57*d* of orbiting scroll 57. This contacting area, however, is extremely small, and as a result is thus subject to seizure as well.

Furthermore, the axial end surface 58*c* of fixed ring 58 is formed by an expensive lathing manufacturing process.

SUMMARY OF THE INVENTION

It is an object of the present invention to provide an Oldham coupling mechanism which has a large supporting surface capable of dispersing the thrust load caused by the compression reaction force.

It is another object of this invention to provide a fluid displacement apparatus which has a lighter Oldham coupling mechanism.

It is another object of this invention to provide a fluid displacement apparatus which operates with less noise and vibration during high speed operation.

In order to obtain the above objects, a scroll type fluid displacement apparatus includes a housing having an inlet port and an outlet port. A fixed scroll is fixedly disposed within the housing and has a circular end plate from which a first spiral element extends. An orbiting scroll has a circular end plate from which a second spiral element extends. The first and second spiral elements interfit at an angular and radial offset to make a plurality of line contacts to define at least one pair of fluid pockets within the interior of the housing. A pair of parallel first grooves are formed on the circular end plate.

A driving mechanism is operatively connected to the orbiting scroll to effect orbital motion of the orbiting scroll. An Oldham coupling mechanism is disposed between the fixed scroll and the orbiting scroll for preventing rotation of the orbiting scroll during orbital motion. The Oldham coupling mechanism comprises a supporting member disposed in the housing so as to face the circular end plate of the orbiting scroll. The supporting member has a pair of parallel grooves formed on one axial end surface thereof. A ring has a pair of parallel first key portions and a pair of parallel second key portions extending from first ends of the first key portions. The second key portions are axially offset from the first key portions. The ring is coupled to the supporting member so that the first key portions engage the grooves of the circular end plate of the orbiting scroll and the second key portions engage the grooves of the supporting means.

Other objects, features and advantages will be apparent to persons of ordinary ski in the art in view of the following detailed description of the invention and the accompanying drawings.

BRIEF DESCRIPTION OF TEE DRAWINGS

DETAILED DESCRIPTION OF THE PREFERRED EMBODIMENTS

Figure 3:
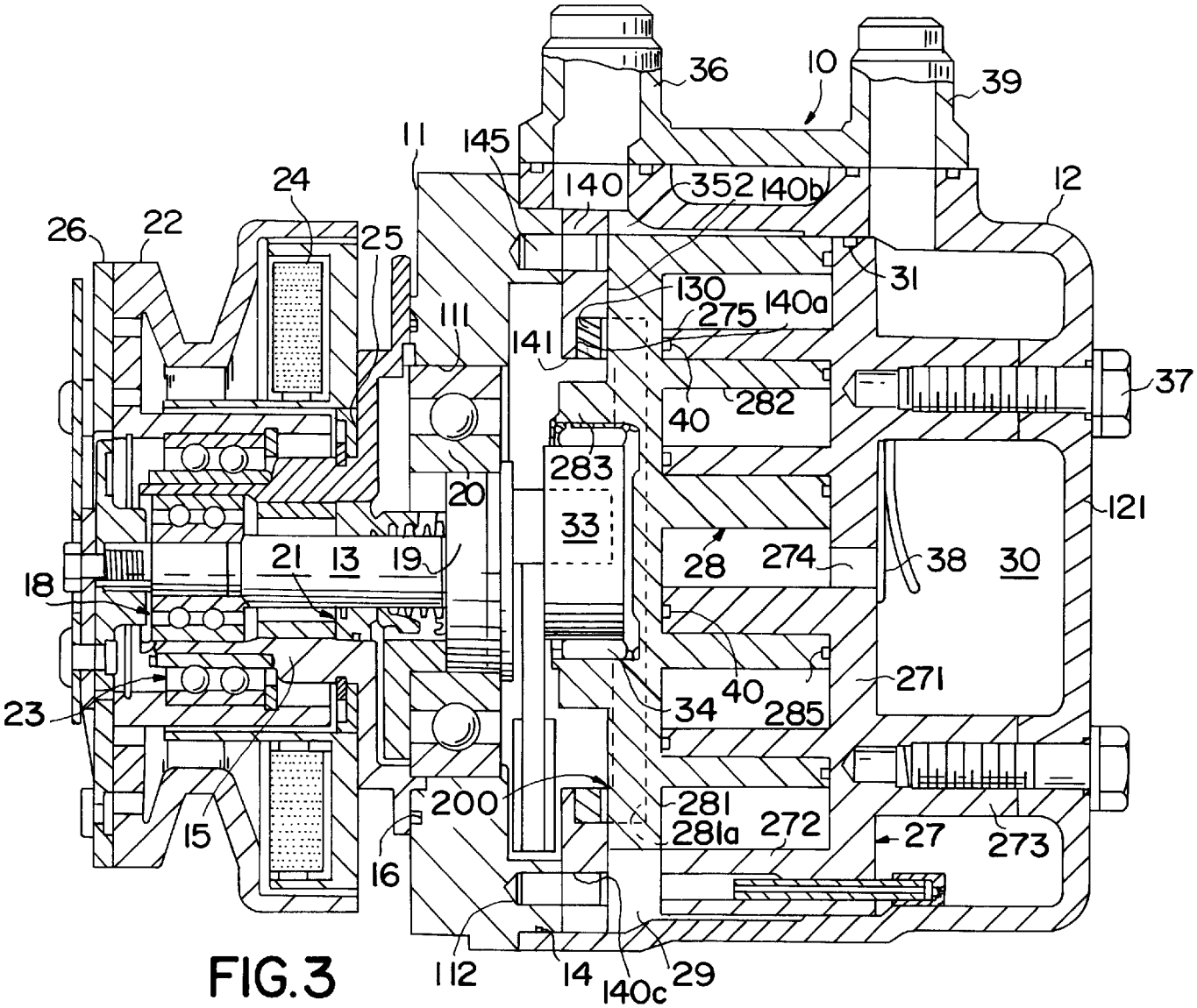
FIG. 3 is a longitudinal cross sectional view of a scroll type refrigerant compressor in accordance with a first preferred embodiment of the present invention.

With reference to FIG. 3, the relevant portions of the fluid displacement apparatus, such as a scroll type refrigerant compressor, in accordance with a first preferred embodiment of the present invention are depicted. For purposes of explanation only, the left side of FIG. 3 will be referenced as the forward end or front of the compressor, and the right side will be referenced as the rearward end or rear of the compressor.

A scroll type compressor includes a compressor housing 10 having a front end plate 11 mounted on a cup-shaped casing 12. An opening 11 is formed in the center of front end plate 11, through which a drive shaft 13 passes. Annular projection 112 is formed in a rear end surface of front end plate 11. Annular projection 112 faces cup-shaped casing 12 and is concentric with opening 111. An outer peripheral surface of annular projection 112 extends into an inner wall of the opening of cup-shaped casing 12 so that the opening of cup-shaped casing 12 is covered by front end plate 11. O-ring 14 is placed between the outer peripheral surface of annular projection 112 and the inner wall of the opening of cup-shaped casing 12 to seal the mating surfaces therebetween.

Annular sleeve 15 projects from the front end surface of front end plate 11 to surround drive shaft 13. Annular sleeve 15 defines a shaft seal cavity 21. Sleeve 15 is formed separately from end plate 11, and is fixed to the front end surface of front end plate 11 by screws (not shown). O-ring 16 is positioned between the end surface of sleeve 15 and front end plate 11. Alternatively, sleeve 15 may be formed integral with end plate 11.

Drive shaft 13 is rotatably supported by sleeve 15 through bearing 18. Drive shaft 13 has disk 19 at its inner end. Disk 19 is rotatably supported by front end plate 11 through bearing 20.

A pulley 22 is rotatably supported by bearing 23 placed on the outer surface of sleeve 15. Electromagnetic coil 24 is fixed about the outer surface of sleeve 15 by support plate 25 and is received in an annular cavity of pulley 22. Armature plate 26 is elastically supported on the end of drive shaft 13. Pulley 22, magnetic coil 24 and armature plate 26 form a magnetic clutch. Drive shaft 13 is driven by an external power source, for example, the engine of an automobile, through the magnetic clutch.

Cup-shaped casing 12 houses fixed scroll 27, orbiting scroll 28, driving mechanism for orbiting scroll 28 and rotation preventing/trust bearing device 200 for orbiting scroll 28. Fixed scroll 27 includes circular end plate 271, wrap or spiral element 272 affixed to or extending from one end surface of end plate 271 and internal threaded bosses 273 axially projecting from the other end surface of end plate 271. An axial end surface of each boss 273 is sealed on the inner end surface of bottom plate portion 121 of cup-shaped casing 12 and fixed by screws 37 to bosses 273. Circular end plate 271 of fixed scroll 278 partitions the inner chamber of cup-shaped casing 12 into front chamber 29 and rear chamber 30. Seal ring 31 is disposed in circumferential groove of circular end plate 271 to form a seal between the inner wall of cup-shaped casing 12 and the outer surface of circular end plate 271. Spiral element 272 of fixed scroll 27 is positioned within front chamber 29.

Cup-shaped casing 12 has a fluid inlet port 36 and a fluid outlet port 39, which are connected to rear and front chambers 29 and 30, respectively. A hole or discharge port 274 is formed through circular end plate 271 at a position near the center of spiral element 272. A reed valve 38 closes discharge port 274.

Orbiting scroll 28, which is located in front chamber 29, includes circular end plate 281. Spiral elements 272 and 282 interfit at an angular offset of 180° and at a predetermined radial offset. Spiral elements 272 and 282 define at least one pair of sealed off fluid pockets between their interfitting surfaces. Orbiting scroll 28 is supported by bushing 33 through bearing 34 placed between bushing 33 and annular boss 282 axial projecting from the end surface of circular end plate 281. Bushing 33 is connected to an inner end of disk 19 at a point radially offset or eccentric to the axis of drive shaft 13.

Figure 4:
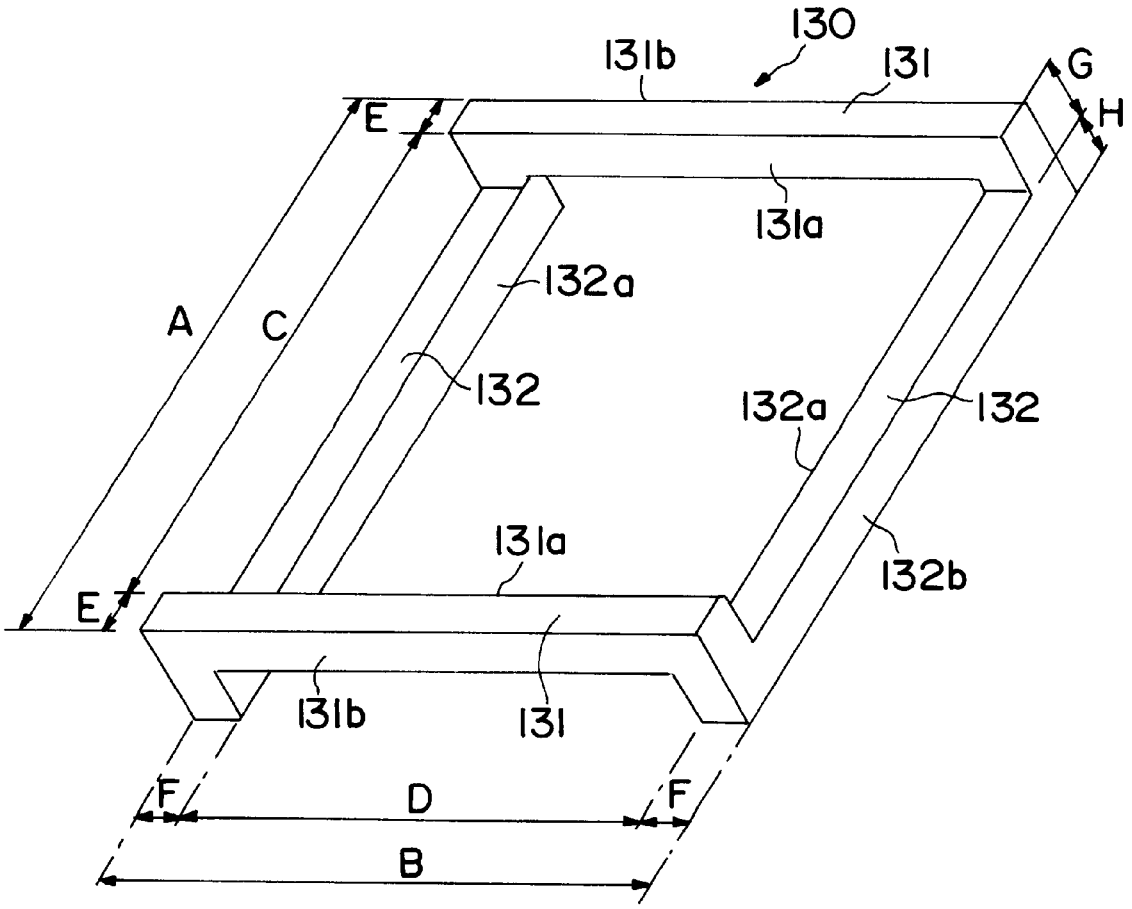
FIG. 4 is an isometric view of the Oldham ring of FIG. 3.
Figure 5:
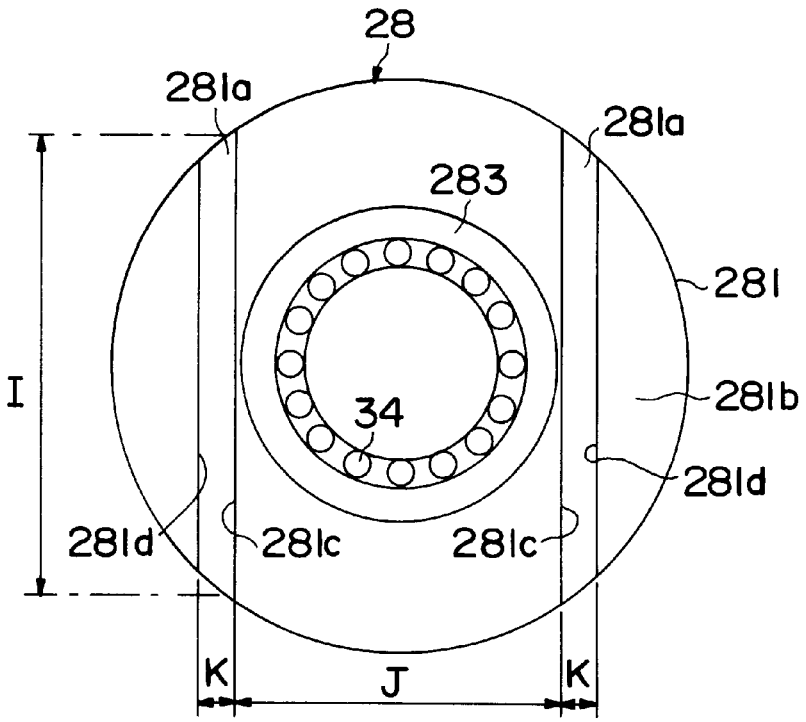
FIG. 5 is a plan view of an orbiting scroll of the scroll type refrigerant compressor in accordance with the first preferred embodiment.
Figure 6:
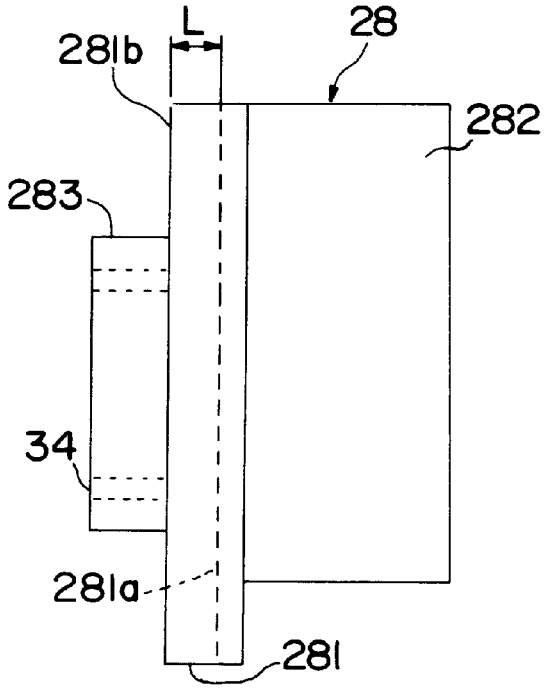
FIG. 6 is a side view of the orbiting scroll of the scroll type refrigerant compressor in accordance with the first preferred embodiment.
Figure 7:
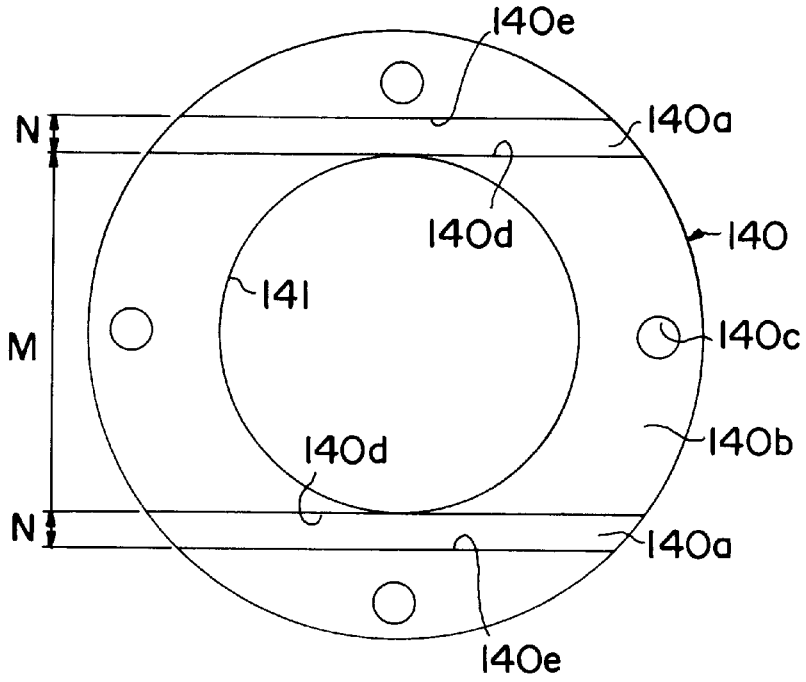
FIG. 7 is a plan view of an Oldham ring of the scroll type refrigerant compressor in accordance with the first preferred embodiment.
Figure 8:
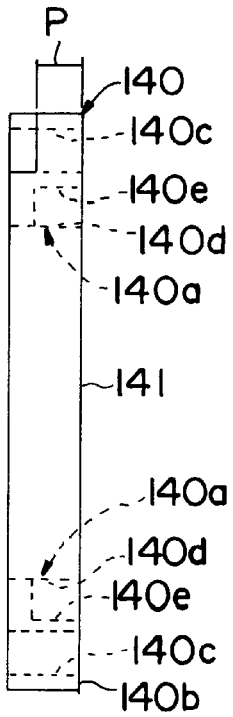
FIG. 8 is a side view of the Oldham ring of the scroll type refrigerant compressor in accordance with the first preferred embodiment.

Referring to FIGS. 3 and 4, rotation of orbiting scroll 28 is prevented by an Oldham coupling mechanism 200. Oldham coupling mechanism 200 comprises Oldham annular plate 140 secured to front end plate 11 by a plurality of pins 145 and Oldham ring 130 disposed between Oldham annular plate 140 and orbiting scroll 28. Oldham ring 130 includes a pair of first parallel rod portions 131 and a pair of second parallel rod portions 132. First rod portions 131 are axially offset from second rod portions 132. First rod portions 131 and second rod portions 132 collectively form a quadrilateral shaped ring, or alternatively may form a parallelogram-shaped ring. Oldham ring 230 is preferably made from sintered metal or die cast aluminum.

Referring to FIGS. 5, 6, 7 and 8, circular end plate 281 (FIGS. 5 and 6) preferably includes a pair of parallel grooves 281*a* formed on opposite sides of boss 283 and extending to the edges of circular end plate 281. Oldham annular plate 140 (FIGS. 7 and 8) includes an opening 141 formed at the center thereof, a plurality of holes 140*a* formed around opening 141 at equal intervals and a pair of parallel grooves 140*a* formed on opposite sides of opening 141. First rod portions 131 are slidably inserted into grooves 140*a* of Oldham annular plate 140 and second rod portions 132 are slidably inserted into grooves 28 la of orbiting scroll 28.

Referring again to FIGS. 4 and 5, length A of second rod portions 132 is preferably equal to or less than length I (FIG. 5) of groove 281*a*. Length A of second rod portions 132 is preferably greater than length B of first rod portions 131 so that annular boss 283 of orbiting scroll 28 may move within Oldham ring 130 while describing an elliptical path.

The thickness H (FIG. 4) of second rod portion of Oldham ring 130 is preferably the same as or smaller than the depth L (FIG. 6) of groove 281*a* of circular end plate 281. Likewise, the thickness G (FIG. 4) of first rod portion 131 of Oldham ring 130 is preferably the same as or smaller than the depth P (FIG. 8) of groove 140*a* of Oldham annular plate 240.

Figure 9:
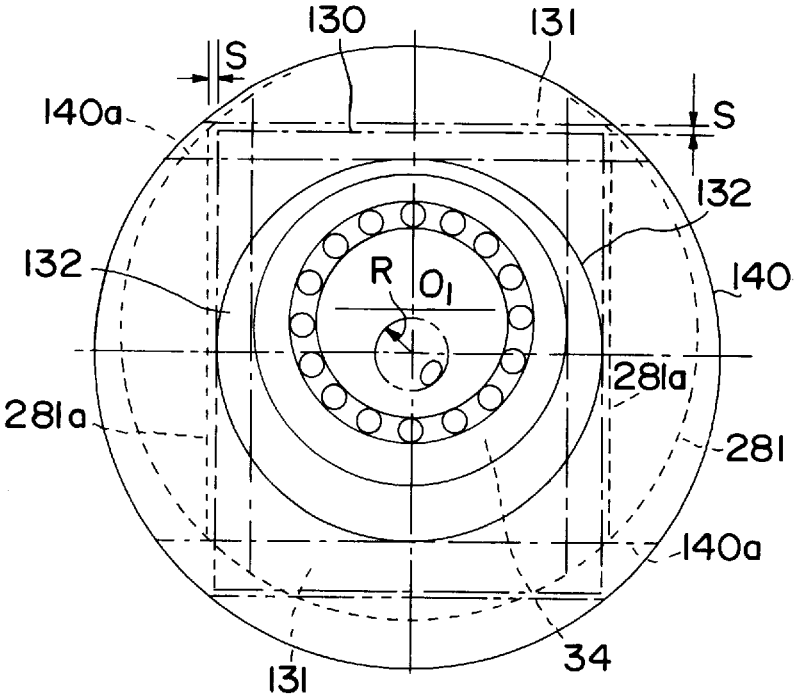
FIG. 9 is a schematic view illustrating the relative movement of an Oldham ring while it prevents the rotation of the orbiting scroll in accordance with the fist preferred embodiment.

Furthermore, the distance D (FIG. 4), which is defined between second rod portions 132, is substantially identical to the distance J (FIG. 5), which is defined between the pair of grooves 281*a* of circular end plate 281. The width K (FIG.5) of grooves 281*b* is preferably greater than the width F (FIG. 4) of second rod portions 132 so as to radial-outwardly form a gap S as shown in FIG. 9. The distance C (FIG. 4), which is defined between first rod portions 131, is substantially the same as distance M (FIG. 7), which is defined between grooves 140*a*. The width N (FIG. 7) of groove 140*a* is preferably greater than the width E (FIG. 4) of first rod portion 131 so as to radially form gap S as shown in FIG. 9.

Therefore, the inner surfaces 131*a* of first rod portion 131 slidably contact inner wall 140*d*, which has an area greater than that of outer wall 140*e*. Likewise, inner surfaces 132*a* of second rod portion 132 slidably contact inner wall 281*c*, which has an area greater than that of outer wall 281*d* of groove 281*a*. Referring to FIG. 9, an elliptical or circular path may be defined by the orbiting motion of the center, $O_1$, of orbiting scroll 28. Center $O_1$ moves along this path as orbiting scroll 28 orbits. A radius, R, may be defined as the radius of the elliptical path.

Figure 1:
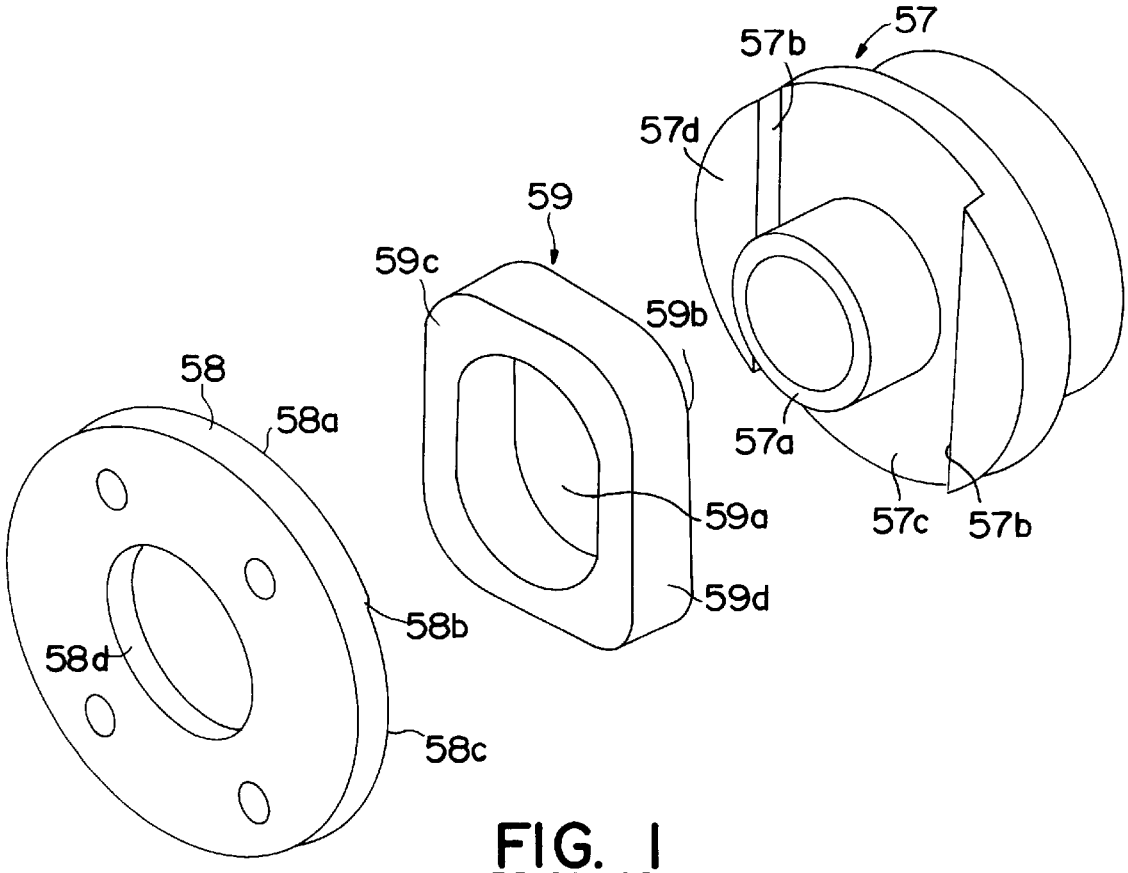
FIG. 1 PRIOR ART
FIG. 1 is a perspective view of an Oldham coupling mechanism in accordance with the prior art.
Figure 2:
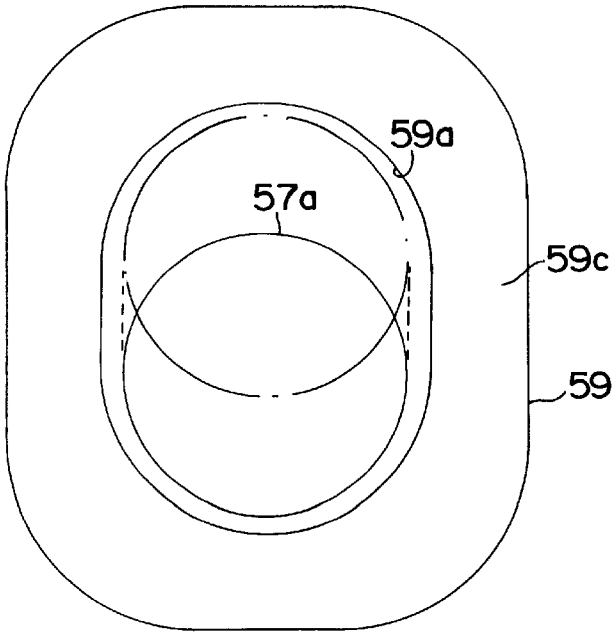
FIG. 2 PRIOR ART
FIG. 2 is a plan view of an Oldham ring of an Oldham coupling mechanism of FIG. 1.

According to these dimensions, Oldham annular plate 140 substantially entirely supports the axial thrust load of orbiting scroll 28. Since the contacting surfaces between end surface 140*b* of Oldham annular plate 140 and end surface 281*a* of circular end plate 281 of orbiting scroll 28 is larger than that of first or second surface 59*b* and 59*c* of Oldham ring 59 in FIGS. 1 and 2 of the prior art, the Oldham coupling mechanism 200 of the preferred embodiment decreases the possibility of seizure.

Oldham coupling mechanism 200 functions as the rotation preventing device for orbiting scroll 28. Fluid from an external fluid circuit, such as an evaporator of a refrigerant circuit (not shown), is introduced into fluid pockets formed between spiral elements 272 and 282. When orbiting scroll 28 orbits, the fluid in the fluid pockets moves to the center of the spiral elements 272 and 282 and is compressed. The compressed fluid from the fluid pockets is discharged to discharge hole 274. The compressed fluid then is discharged to the external fluid circuit through outlet port 39.

Figure 10:
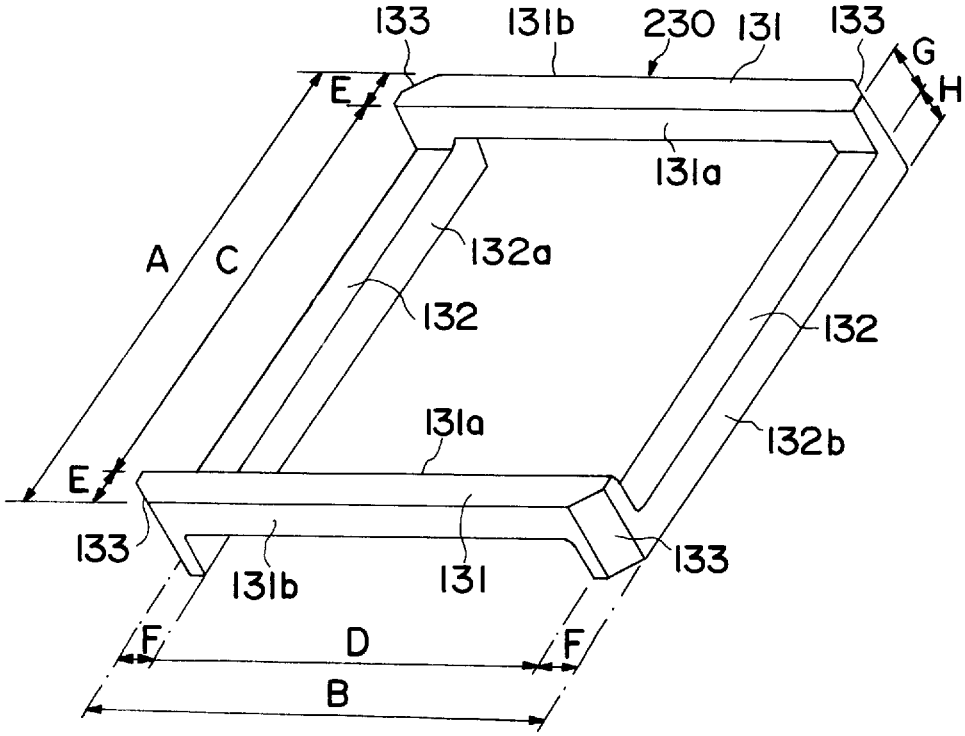
FIG. 10 is an isometric view of an Oldham ring according to a second preferred embodiment.

Referring to FIG. 10, a second preferred embodiment is depicted. Elements similar to those of the first preferred embodiment are designated with similar reference numerals and the discussion will be reserved primarily for the differences between the first and second embodiments. In the second embodiment, Oldham ring 230 is slightly modified to include beveling 133 at the outer corners thereof.

Figure 11:
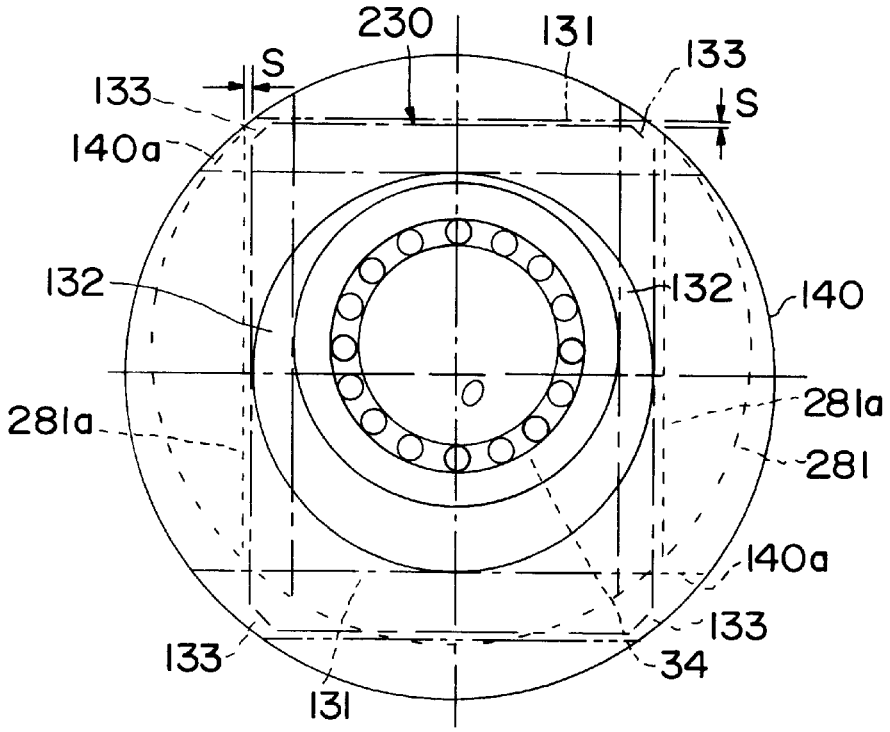
FIGS. 11–13 are schematic views illustrating the relative movement of the Oldham ring while preventing the rotation of the orbiting scroll in accordance with the second preferred embodiment.
Figure 12:
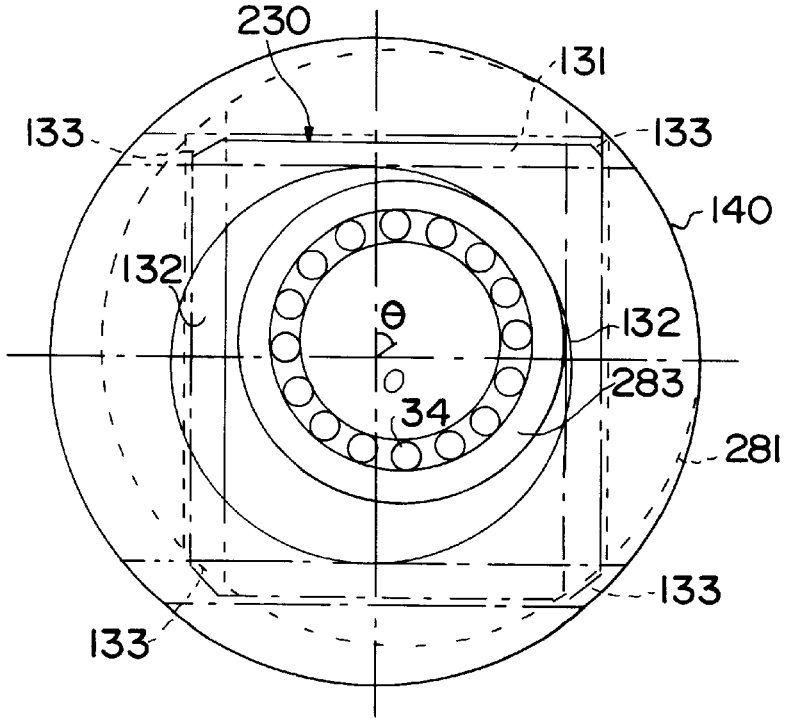
Figure 13:
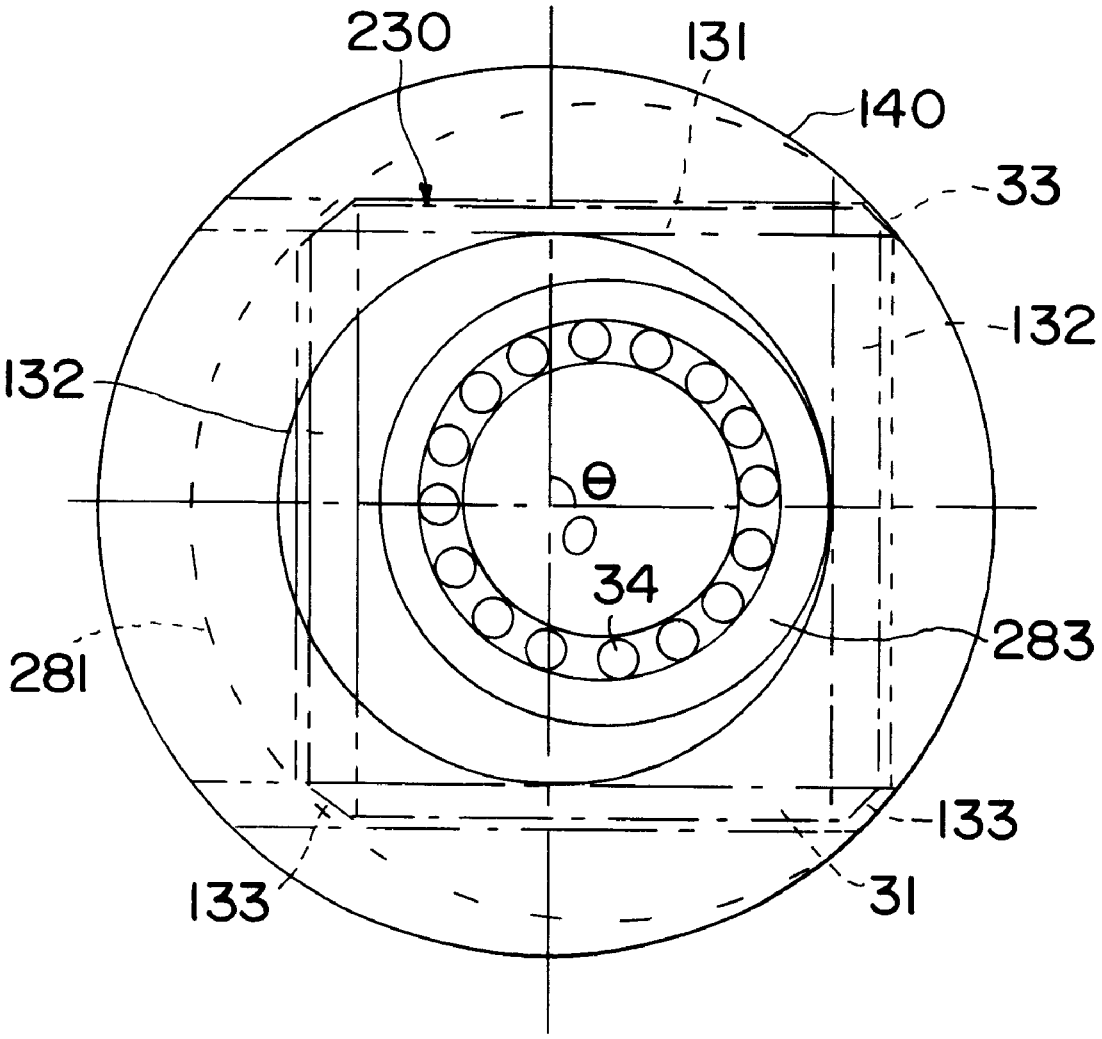

Referring to FIGS. 11, 12 and 13 in conjunction with FIG. 10, operation of the second preferred embodiment is depicted. The center of orbiting scroll 28 moves around the center point 0 of the fixed scroll 27. The relative positions of fixed scroll 27 and orbiting scroll 28 at orbiting angles of 0°, 45° and 90° are indicated in FIGS. 12, 12 and 13, respectively. At those times, wall surfaces 131*a* (FIG. 10) of first rod portion 131 slide along inside walls of grooves 140*a*. Oldham plate 140, which is stationarily coupled to the front end plate, prevents Oldham ring 130 as well as orbiting scroll 28 from rotating. At the same time, the inner wall surfaces 132*a* (FIG. 10) of second rod portions 132 slide along the inside walls of grooves 281*a* so that second rod portions are subjected to rotational forces from orbiting scroll 28.

Substantially the same advantages are obtained in the first and second embodiments. Furthermore, beveling 133 allows for the decrease in the diameter of cup-shaped casing 12 since the largest outer dimension of Oldham ring 230 (FIG. 10) is smaller than that of Oldham ring 130 in FIG. 4.

Furthermore, the weight of Oldham ring 230 (FIG. 10) is less than the weight of Oldham zing 130 of FIG. 4, which can lead to a commensurate reduction in noise and vibration of the compressor as described with reference to the prior art.

This invention has been described in connection with the preferred embodiments, but these embodiments are merely for example only, and the invention should not be interpreted as limited thereto. It will be apparent to those skilled in the art that other variations or modifications can be made within the scope of the invention as defined by the appended claims. Thus, while the preferred embodiments illustrate the invention in scroll type displacement apparatus, the invention can be used in any other high pressure type fluid displacement apparatuses.

I claim:

1. A scroll type fluid displacement apparatus comprising:

a housing having an inlet port and an outlet port;

a fixed scroll fixedly disposed within said housing and having a circular end plate from which a first spiral element extends into the interior of said housing;

an orbiting scroll having a circular end plate from which a second spiral element extends, said first and second spiral elements interfitting at an angular and radial offset to make a plurality of line contacts to define at least one pair of fluid pockets within the interior of said housing, said orbiting scroll having a pair of parallel first grooves formed on said circular end plate;

a driving mechanism operatively connected to said orbiting scroll to effect orbital motion of said orbiting scroll; and an Oldham coupling mechanism coupled to said orbiting scroll for preventing rotation of said orbiting scroll during orbital motion, said Oldham coupling comprising:

a supporting means disposed in said housing so as to face said circular end plate of said orbiting scroll, said supporting means having a pair of parallel second grooves formed on one end surface thereof; and a ring having a pair of first parallel key portions and a pair of second parallel key portions connected to ends of said first key portions, said second key portions axially offset from said first key portions and a length of said first key portions is greater than a length of said second key portions, said first key portions engaging said pair of first grooves of said circular end plate, said second key portions engaging said pair of second grooves of said supporting means.

2. The fluid displacement apparatus of claim 1, wherein the depth of said first grooves of said circular end plate is greater than the thickness of said first key portions of said ring, and the depth of said second grooves of said supporting means is greater than the thickness of said second key portions of said ring, said end surface of said supporting means directly contacting said circular end plate of said orbiting scroll.

3. The fluid displacement apparatus of claim 1, wherein said supporting means comprises an annular ring member secured to said housing by a plurality of bolts.

4. The fluid displacement apparatus of claim 1, wherein the width of said first grooves of said circular end plate of said orbiting scroll is greater than the width of said first key portions of said ring, and the width of said second grooves of said end surface of said supporting means is greater than the width of said second key portions of said ring.

5. The fluid displacement apparatus of claim 4, wherein the inner distance between said second key portions is substantially equal to the inner distance between said second grooves of said end surface of said supporting means, and the inner distance between said first key portions is substantially equal to the inner distance between said first grooves of said circular end plate.

6. A scroll type fluid displacement apparatus comprising:

a housing having an inlet port and an outlet port;

a fixed scroll fixedly disposed within said housing and having a circular end plate from which a first spiral element extends into the interior of said housing, an orbiting scroll having a circular end plate from which a second spiral element extends, said first and second spiral elements interfitting at an angular and radial offset to make a plurality of line contacts to define at least one pair of fluid pockets within the interior of said housing said orbiting scroll having a pair of parallel first grooves formed on said circular end plate;

a driving mechanism operatively connected to said orbiting scroll to effect orbital motion of said orbiting scroll, and an Oldham coupling mechanism coupled to said orbiting scroll for preventing rotation of said orbiting scroll during orbital motion, said Oldham coupling comprising:

a supporting means disposed in said housing so as to face said circular end plate of said orbiting scroll, said supporting means having a pair of parallel second grooves formed on one end surface thereof, and a ring having a pair of first parallel key portions and a pair of second parallel key portions connected to ends of said first key portions, said second key portions axially offset from said first key portions, said ring comprising a parallelogram shape wherein a length of said first key portions of said ring is greater than a length of said second key portions of said ring, and wherein said ring includes beveling formed at each corner thereof, said first key portions engaging said pair of first grooves of said circular end plate, said second key portions engaging said pair of second grooves of said supporting means.

* * * * *